US007677679B2

(12) United States Patent
Hsiung et al.

(10) Patent No.: US 7,677,679 B2
(45) Date of Patent: Mar. 16, 2010

(54) SLIDE ASSEMBLY

(75) Inventors: Hai-Hung Hsiung, Taipei Hsien (TW); Zhao-Guo Wen, Shenzhen (CN); Li-Hui Gao, Shenzhen (CN); Jie Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 231 days.

(21) Appl. No.: 11/778,670

(22) Filed: Jul. 17, 2007

(65) Prior Publication Data

US 2008/0307610 A1 Dec. 18, 2008

(30) Foreign Application Priority Data

Jun. 15, 2007 (CN) ..... 2007 2 0200479 U

(51) Int. Cl.
*A47B 88/00* (2006.01)

(52) U.S. Cl. ..... 312/333; 312/334.44

(58) Field of Classification Search ..... 312/333, 312/334.44–334.47, 334.5, 334.4, 334.7–334.9, 312/334.1, 334.11; 384/21
See application file for complete search history.

(56) References Cited

U.S. PATENT DOCUMENTS

| | | | | |
|---|---|---|---|---|
| 7,404,611 | B1 * | 7/2008 | Que | 312/334.46 |
| 2003/0209958 | A1 * | 11/2003 | Hwang et al. | 312/334.46 |
| 2008/0018214 | A1 * | 1/2008 | Huang | 312/334.46 |
| 2008/0124009 | A1 * | 5/2008 | Peng et al. | 384/21 |
| 2008/0135714 | A1 * | 6/2008 | Huang et al. | 248/429 |
| 2008/0150409 | A1 * | 6/2008 | Huang et al. | 312/334.46 |
| 2008/0197758 | A1 * | 8/2008 | Mushan et al. | 312/334.1 |
| 2008/0315741 | A1 * | 12/2008 | Huang et al. | 312/334.7 |
| 2009/0001864 | A1 * | 1/2009 | Huang et al. | 312/333 |

* cited by examiner

*Primary Examiner*—Janet M Wilkens
(74) *Attorney, Agent, or Firm*—Frank R. Niranjan

(57) ABSTRACT

A slide assembly includes a first slide (10), a second slide (20) slidably attached to the first slide, and a third slide (30) incorporated with a releasing member (50) slidably attached to the second slide. The first slide includes a stop (14) and a block (16). The second slide has a stop piece (28) and a slot (26) for movably receiving a retention pin (40). When the first, second, and third slides are in a fully extended state, the retention pin and the stop piece are resisted by the stop and the block of the first slide respectively, thereby restraining sliding movement between the second slide and the first slide; when the third slide is retracted from the fully extended state to a semi-extended state, the retention pin is lifted by the releasing member and disengaged from the stop, thereby allowing the second slide to retract into the first slide.

16 Claims, 4 Drawing Sheets

SLIDE ASSEMBLY

BACKGROUND

1. Field of the Invention

The present invention relates to slide assemblies. In particular, the present invention relates to a three-section slide assembly with simple retention and releasing mechanisms.

2. Description of related art

Typical slide assemblies comprise two or more telescoping slide segments. An outer or stationary slide segment is mounted to a frame of a rack structure, and an inner or load-carrying slide segment is movably attached to the stationary slide segment. The stationary slide segment is usually C-shaped and defines a channel in which the inner slide segment is slidable to extend or retract the slide assembly. For example, U.S. Pat. No. 6,705,689 discloses a slide assembly including a first track, a second track, and a third track. The first track includes a first stop and an engaging block. The second track is slidably received in the first track. The second track includes a second stop for abutting against the first stop of the first track. The second track further includes a first engaging member on an end thereof. The first engaging member includes an extension member, the extension member including an engaging section and a foot. The third track is slidably received in the second track. The third track includes a second engaging member for abutting against a third stop of the second track. The second engaging member includes an engaging edge and a leg. The leg is pressable to allow disengagement of the engaging edge from a protrusion on the third stop. When the second track moves inward into the first track, the engaging section abuts against the engaging block, thereby preventing inward movement of the second track; and when the foot of the first engaging member is pressed against by a bottom of the third track, the extension member is lifted for disengaging the engaging section with the retaining portion of the engaging block. However, such construction is relatively expensive and has not found wide acceptance.

What is needed, therefore, is a slide assembly with simple retention and releasing mechanisms.

SUMMARY

A slide assembly includes a first slide, a second slide slidably attached to the first slide, and a third slide incorporated with a releasing member slidably attached to the second slide. The first slide includes a stop and a block. The second slide has a stop piece and a slot for movably receiving a retention pin. When the first, second, and third slides are in a fully extended state, the retention pin and the stop piece are resisted by the stop and the block of the first slide respectively, thereby restraining sliding movement between the second slide and the first slide; when the third slide is retracted from the fully extended state to a semi-extended state, the retention pin is lifted by the releasing member and disengaged from the stop, thereby allowing the second slide to fully retract into the first slide.

Other advantages and novel features will be drawn from the following detailed description of a preferred embodiment with attached drawings, in which:

DETAILED DESCRIPTION OF THE EMBODIMENT

Figure 1:
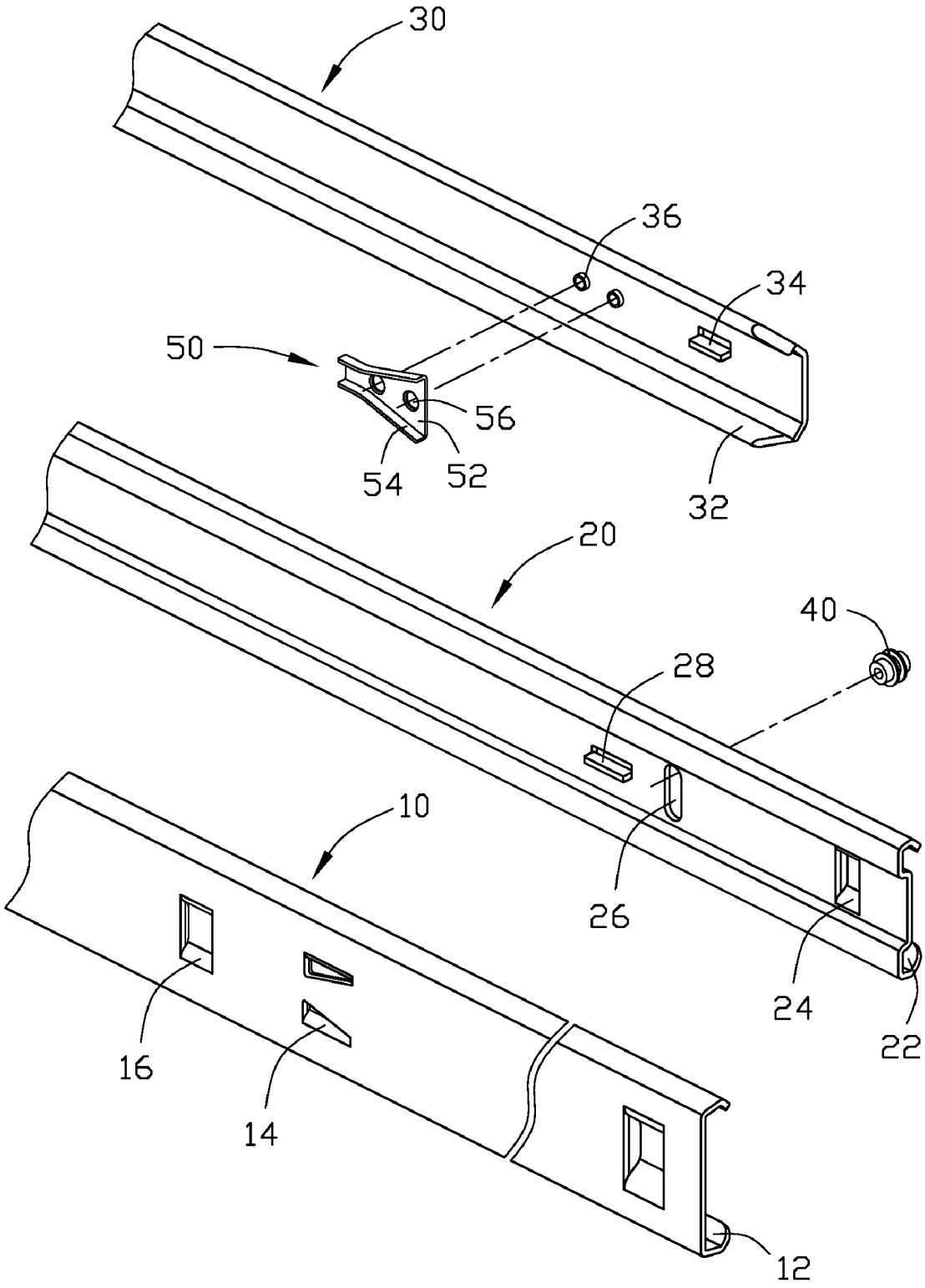
FIG. 1 is an exploded, isometric partial view of a slide assembly of a preferred embodiment of the present invention, the slide assembly including an outer slide, an intermediate slide, an inner slide, a retention pin, and a releasing member.

Referring to FIG. 1, a slide assembly of the preferred embodiment of the present invention includes an outer slide 10, an intermediate slide 20, and an inner slide 30, a retention pin 40, and a releasing member 50.

Figure 2:
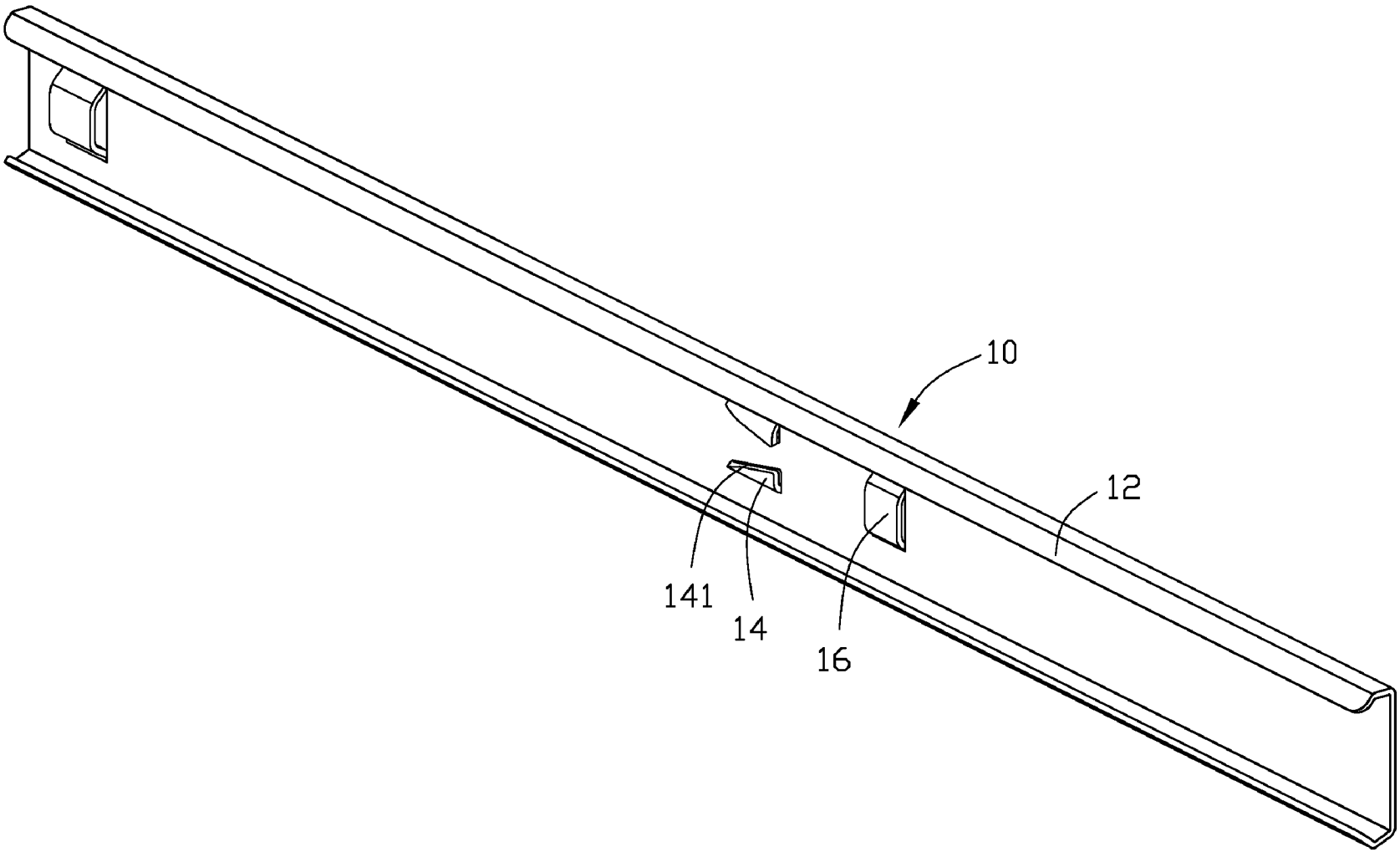
FIG. 2 is an isometric, exploded view of the outer slide of FIG. 1, but shown from another aspect.

Referring also to FIG. 2, the outer slide 10 includes a pair of guideways 12 for allowing longitudinal sliding movement of the intermediate slide 20 in the outer slide 10 and restraining lateral movement of the intermediate slide 20. The outer slide 10 further includes a pair of stops 14 each having an inclined edge 141. The stops 14 are generally triangle-shaped and extended obliquely from the inner side of the outer slide 10. A first block 16 protrudes from the inner side of the outer slide 10.

The intermediate slide 20 includes a pair of guideways 22 for allowing longitudinal sliding movement of the inner slide 30 in the intermediate slide 20 and restraining lateral movement of the inner slide 30. A second block 24 protrudes from a front portion of the inner side of the intermediate slide 20. A lateral slot 26 is defined in the intermediate slide 20, transverse to a longwise direction of the intermediate slide 20. A stop piece 28 is extended perpendicularly towards the outer slide 10 from the intermediate slide 20 near the slot 26. The retention pin 40 is mounted in the slot 26 of the intermediate slide 20 and capable of moving upwards and downwards along the slot 26. A central portion of the retention pin 40 is received in the slot 26, leaving the two ends of the retention pin 40 protruding from opposite sides of the intermediate slide 20. A width of the slot 26 is approximately equal to a diameter of the central portion of the retention pin 40. A height of the stop piece 28 is about equal to a half of the length of the slot 26.

The inner slide 30 includes a pair of flanges 32 for being received in the guideways 22 of the intermediate slide 20. A stop piece 34 corresponding to the second block 24 of the intermediate slide 20 protrudes perpendicularly from the inner slide 30 towards the intermediate slide 20. A pair of fixing posts 36 protrudes from the inner slide 30. The releasing member 50 includes a body 52 and a pair of inclined flanges 54 extending perpendicularly from upper and lower inclined edges of the body 52 respectively. A pair of fixing holes 56 corresponding to the fixing posts 36 of the inner slide 30 is defined in the body 52 of the releasing member 50 for mounting the releasing member 50 to the inner slide 30. The releasing member 50 could instead be integrally formed on the inner slide 30.

Figure 3:
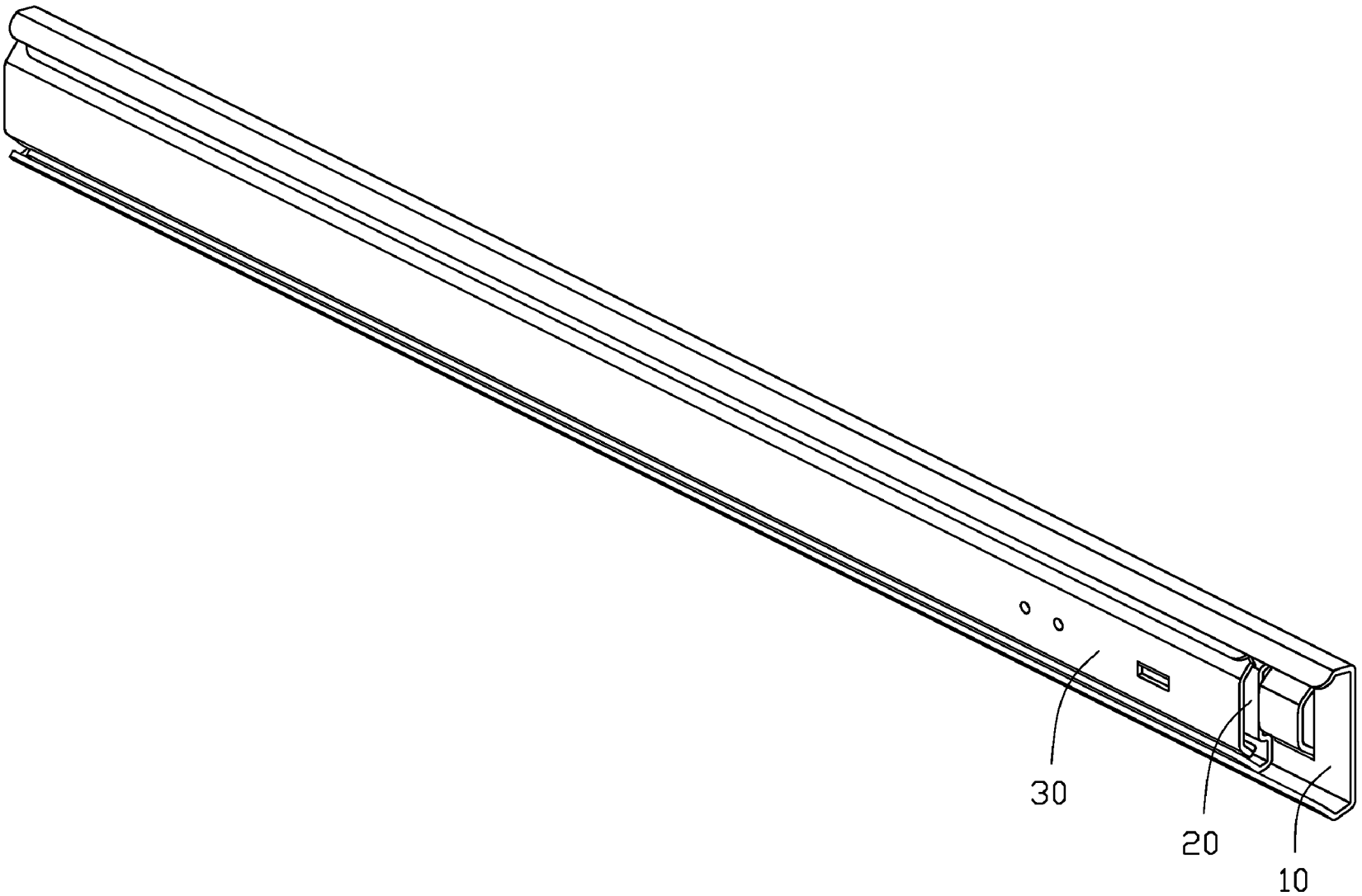
FIG. 3 is an assembled view of the slide assembly of FIG. 1, but shown from another aspect.
Figure 4:
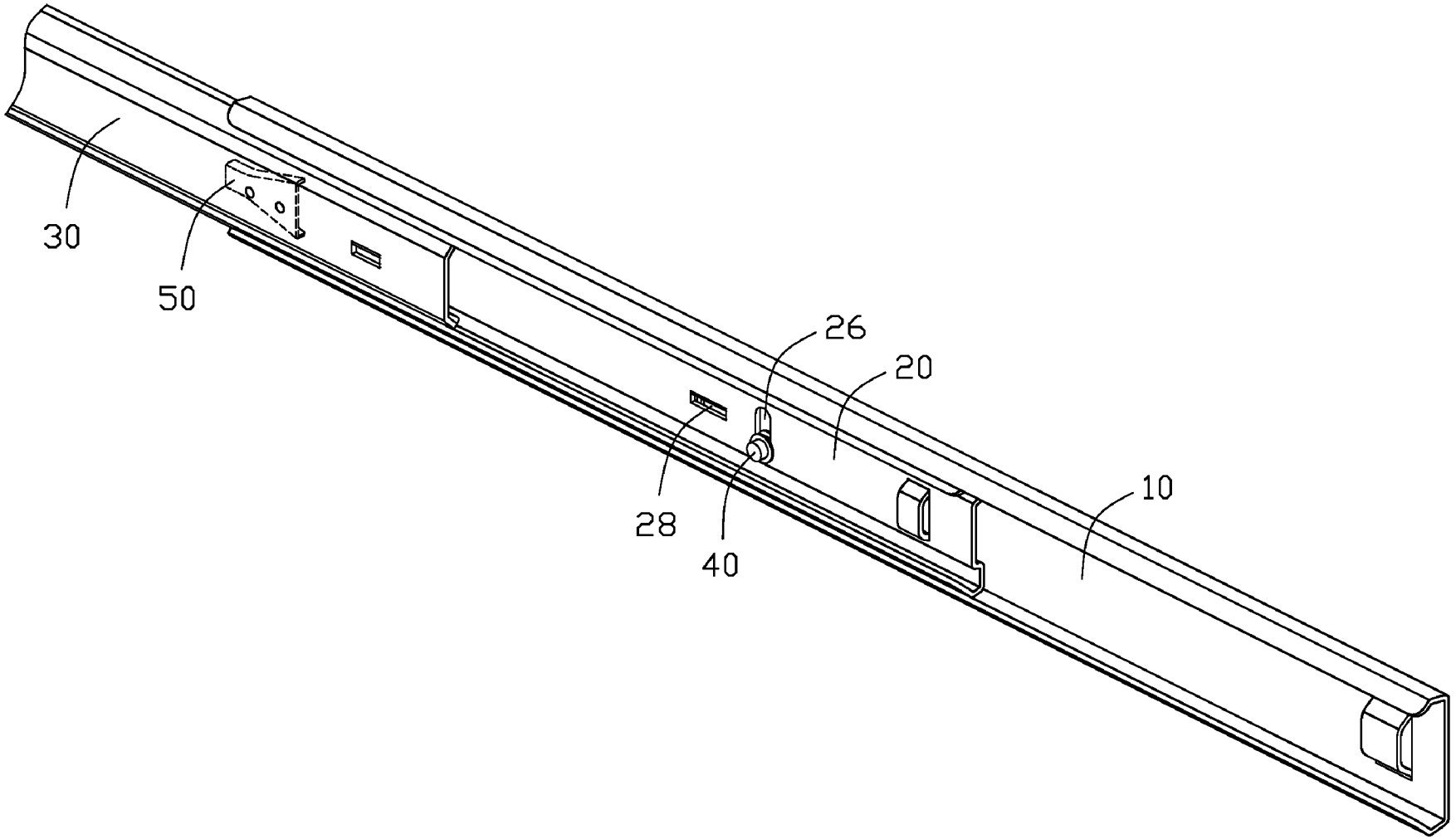
FIG. 4 is a partial view of the slide assembly of FIG. 3 in a fully-extended state.

Referring also to FIG. 3 and FIG. 4, in assembly, the intermediate slide 20 incorporated with the movable retention pin 40 is slidably mounted to the outer slide 10 via the guideways 12, and the inner slide 30 incorporated with the releasing member 50 is slidably mounted to the intermediate slide 20 via the guideways 22. The length of the slot 26 is more than double the maximum height of the inclined stops 14. The maximum height of the lower inclined flange 54 is more than the maximum height of the lower stop 14 of the outer slide 10.

During the action of extending the sliding assembly from a fully retracted position, the intermediate slide 20 first slides out from the outer slide 10, and then the inner slide 30 slides out from the intermediate slide 20 until full-extension of the sliding assembly is achieved. During extension of the intermediate slide 20, a first end of the retention pin 40 is moving upwards and outwards along the inclined edge 141 of the lower stop 14 until completely sliding over the stop 14 and falling back to the bottom of the slot 26 of the intermediate slide 20. Thus, the retention pin 40 abuts against the rear lower end of the stop 14 for preventing the intermediate slide 20 retracting into the outer slide 10. Meanwhile, the rear end of the stop piece 28 of the intermediate slide 20 is resisted by the first block 16 of the outer slide 10 for preventing further extension of the intermediate slide 20. Therefore, the intermediate slide 20 is stationary and locked relative to the outer slide 10 in the fully-extended s position.

During retraction of the slide assembly, the inner slide 30 is first retracted into the intermediate slide 20 until reaching a semi-extended position where the inner slide 30 is retracted into the intermediate slide 20, but the intermediate slide 20 is not yet retracted into the outer slide 10. During the inner slide 30 sliding inwards along the guideways 22 of the stationary intermediate slide 20, the releasing piece 50 is moving towards the retention pin 40 and then the second end of the retention pin 40 is carried to a central portion of the slot 26 from the bottom of the slot 26 by the lower inclined flange 54 of the releasing piece 50. Thus, the retention pin 40 climbs up, and disengages from the lower stop 14 in the semi-extended position. Then the intermediate slide 20 together with the inner slide 30 is capable of retracting into the outer slide 10 from the locked position to put the slide assembly into the fully retracted position.

It is to be understood, however, that even though numerous characteristics and advantages have been set forth in the foregoing description of a preferred embodiment, together with details of the structure and function of the preferred embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A slide assembly, comprising:

a first slide comprising a stop protruding therefrom, the stop comprising an inclined edge;

a second slide slidably coupled to the first slide, comprising a slot defined therein;

a retention pin movably received in the slot of the second slide, the retention pin having two ends protruding from opposite sides of the second slide respectively; and a third slide slidably coupled to the second slide, the third slide including a releasing member, the releasing member comprising an inclined flange;

wherein the second slide is slidable along the first slide from a retracted position to a predetermined extended position where the retention pin is blocked by the stop after one end of the retention pin climbing over the inclined edge of the stop and falling to a bottom of the slot for preventing retraction movement of the second slide at the predetermined extended position; and wherein the third slide is slidable along the second slide from an extended position to a semi-extended position where another end of the retention pin is lifted by the inclined flange of the releasing member to disengage the retention pin from the stop of the first slide for allowing retraction movement of the second slide from the predetermined extended position;

wherein the releasing member comprises a body attached to the third slide, the inclined flange of the releasing member is extended perpendicularly from an inclined edge of the body.

2. The slide assembly as described in claim 1, wherein the first slide further comprises a block, and the second slide further comprises a stop piece for resisting against the block for preventing further extension of the second slide from an extended position relative to the first slide.

3. The slide assembly as described in claim 2, wherein the length of the slot of the second slide is more than the maximum height of the inclined edge of the stop of the first slide, the width of the slot is about equal to the diameter of a central portion of the retention pin; the stop is extended from a lower portion of the first slide.

4. The slide assembly as described in claim 3, wherein the maximum height of the inclined flange of the releasing member is not less than that of the inclined edge of the stop of the first slide.

5. The slide assembly as described in claim 3, wherein the stop piece of the second slide is higher than the stop of the first slide.

6. The slide assembly as described in claim 1, wherein the slot is laterally defined in the second slide, and the first, second, and third slides are slidable longitudinally relative to each other.

7. The slide assembly as described in claim 1, wherein the stop of the first slide is generally triangle-shaped and extended obliquely from an inner side of the first slide.

8. A slide assembly comprising:

a first slide comprising a stop and a block protruding from an inner side thereof;

a second slide slidably attached to the inner side of the first slide, the second slide having a slot defined therein, and a stop piece corresponding to the block of the first slide extending therefrom, a retention pin being movable received in the slot with its two ends protruding from two opposite sides of the second slide respectively; and a third slide slidably attached to the second slide, the third slide including a releasing member;

wherein the second slide is slidable along the first slide from a retracted position to a predetermined extended position where the retention pin and the stop piece of the second slide are resisted by the stop and the block of the first slide respectively for restraining either retraction or extension movement of the second slide along the first slide; and wherein the third slide is slidable along the second slide from an extended position to a semi-extended position where the retention pin is lifted by the releasing member and disengaged from the stop of the first slide for allowing the second slide together with the third slide to retract into the first slide to reach a fully retracted state.

9. The slide assembly as described in claim 8, wherein the stop of the first slide has an inclined edge for lifting the retention pin to a top thereof, the retention pin is resisted against the stop after falling to the bottom of the slot from the top of the stop for restraining retracting movement of the second slide.

10. The slide assembly as described in claim 9, wherein the releasing member has an inclined flange for lifting the retention pin from the bottom of the slot to disengage the retention pin from the stop of the first slide, thereby allowing retracting movement of the second slide.

11. The slide assembly as described in claim 10, wherein the releasing member comprises a body attached to the third slide, the inclined flange of the releasing member is extended perpendicularly from an inclined edge of the body.

12. The slide assembly as described in claim 11, wherein the stop piece is extended perpendicularly from the second slide and higher than the stop of the first slide, the stop is formed at a lower portion of the first slide.

13. The slide assembly as described in claim 12, wherein the length of the slot of the second slide is more than the maximum height of the inclined edge of the stop of the first slide, the width of the slot is substantially equal to the diameter of the central portion of the retention pin.

14. The slide assembly as described in claim 13, wherein the central portion of the retention pin is movably received in the slot of the second slide, and two ends of the retention pin are protruding from opposite sides of the second slide respectively.

15. The slide assembly as described in claim 13, wherein the maximum height of the inclined flange of the releasing member is more than that of the inclined edge of the stop of the first slide.

16. A slide assembly comprising:

a first slide including a pair of stop members, one of the stop members having a first sloping portion, the first sloping portion sloping up in a lengthwise direction of the first slide from a first end of the first sloping portion to a second opposite end thereof;

a second slide including a slot defined therein;

a third slide including a releasing member, the releasing member including a pair of second sloping portions; and a retention pin engaged in the slot of the second slide and reciprocally movable in the slot and slidable on the first sloping portion of the stop member and one of the second sloping portions of the releasing member;

wherein the second slide is coupled to the first slide and slidable relative to the first slide between a retracted position where the retention pin is spaced apart from the stop member and the first end of the first sloping portion thereof faces toward the retention pin, and an extended position where the retention pin is located adjacent to the second end of the first sloping portion, and the first end thereof faces away from the retention pin;

wherein the third slide is coupled to the second slide and slidable relative to the second slide between an extended position where the releasing member is spaced apart from the retention pin, and a retracted position where the retention pin is located on a higher end of one of the second sloping portions.

* * * * *